United States Patent [19]

Sohlberg

[11] 4,070,846

[45] Jan. 31, 1978

[54] SUPPORTING FRAMEWORK FOR A SHELTER SHED

[76] Inventor: Pentti Aimo Johannes Sohlberg, Paneliantie 48 A, 00940 Helsinki 94, Finland

[21] Appl. No.: 728,853

[22] Filed: Oct. 1, 1976

[30] Foreign Application Priority Data

Oct. 10, 1975 Finland ..... 752824

[51] Int. Cl.[2] ..... E04B 1/32

[52] U.S. Cl. ..... 52/641; 52/86; 403/172

[58] Field of Search ..... 52/86, 641, 640, 80, 52/81; 403/170, 171, 176, 92, 93, 91, 102

[56] References Cited

U.S. PATENT DOCUMENTS

| | | | |
|---|---|---|---|
| 3,708,928 | 1/1973 | Gaspers | 52/641 |

FOREIGN PATENT DOCUMENTS

| | | | |
|---|---|---|---|
| 1,285,894 | 1/1962 | France | 52/86 |
| 1,525,278 | 5/1968 | France | 52/70 |
| 1,299,106 | 7/1969 | Germany | 52/81 |
| 417,627 | 6/1947 | Italy | 52/86 |
| 150,965 | 7/1930 | Switzerland | 403/102 |
| 621,387 | 4/1949 | United Kingdom | 52/86 |

*Primary Examiner*—Price C. Faw, Jr.
*Assistant Examiner*—Henry Raduazo
*Attorney, Agent, or Firm*—Millen & White

[57] ABSTRACT

A supporting framework for a shelter shed which framework comprises mutually spaced parallel support arches and transversal beams interconnecting said support arches. Each support arch comprises several arch elements connected to each other longitudinally one after the other by means of articulated joints positioned at the ends of the arch elements. Said joints consist of double brackets each provided with two separated holes having parallel axes for fastening pins. Two double brackets are mounted at each end of each arch element at a distance from each other so that the holes of both double brackets are positioned in pairs coaxial with each other and the axes of said holes are parallel with the radius of curvature of the support arch. The double brackets of two adjacent arch elements are fastened to each other by means of two fastening pins inserted in said brackets through said holes. Subsequent arch elements are pivotable side by side around one of said fastening pins when the other fastening pin is removed.

7 Claims, 13 Drawing Figures

SUPPORTING FRAMEWORK FOR A SHELTER SHED

The subject of the present invention is a supporting framework for a shelter shed, which framework consists of support arches and of transversal beams interconnecting the support arches with mutual distances, each support arch comprising several arch elements, which are connected to each other longitudinally one after the other by means of joints positioned at the ends of the arch elements, which joints comprise two pairs of articulated joints positioned at a distance from each other.

Shelter sheds are previously known in which similar supporting frameworks are used for supporting the protective covering. Such shelter sheds are intended for use mainly at building sites and in industry mainly as temporary protective constructions which can be assembled and disassembled relatively easily and rapidly. The support arches of the supporting frame of the shelter shed usually consist of mutually identical arch elements which are rigidly interconnected by means of various pin joints. The arch elements are then connected with each other so as to constitute arches of a desired span, which arches are thereupon lifted upright preferably right at the erecting site.

A supporting framework for a shelter shed of the described type is suggested, for example, in the German Letters Pat. No. 268,294. However, it is a considerable drawback of supporting frameworks of this type that the joints between the arch elements require complete detaching of the arch elements from each other when the support arches are disassembled for storage or transport. This makes the assembly and disassembly of the support arches essentially more difficult and slower.

The object of the present invention is to provide a supporting framework for a shelter shed which eliminates the above drawback, and this object is reached by means of the supporting framework in accordance with the invention, which is characterized in that the articulated joints of the arch elements consist of double brackets which are provided with through holes for fastening pins or equivalent, the holes of the double brackets positioned at the same end of each arch element being in pairs coaxial with each other and the axes of the holes being parallel with the radius of curvature of the support arch so that subsequent arch elements can be pivoted side by side around the axis of one of the hole groups constituted by the brackets of each joint.

In accordance with the invention, a supporting framework is obtained in which the joints of the arch elements permit "folding" of the arch elements of the support arch side by side into a bundle by removal of the fastening pin placed in one of the hole groups of the double brackets at each joint and by pivoting the elements in the form of a zigzag against each other. The arch elements of the support arches can hereby be stored and transported as one small-size unit in which the arch elements are already preliminarily interconnected, which makes the assembly and disassembly easier and faster. The arch elements being of a flat construction, their height being essentially larger than their width, the arch elements pivoted with their flat sides against each other take only very little space. Despite the pivotability of the arch elements, the elements can, however, simply be converted into a rigid support arch by fitting a second fastening pin through the other group of holes of the double brackets.

It is preferable that the fastening pins extend through the coaxial holes of both of the pairs of double brackets positioned at a distance from each other at the joint between the arch elements. In this way, the fastening pins can, at the same time, be used for fastening the transversal beams to the support arches.

The invention will be explained more closely below with reference to the attached drawings, wherein FIG. 1 is a schematical perspective view of a preferred embodiment of a supporting framework in accordance with the invention, FIGS. 2, 3, and 4 are top, end, and perspective views, respectively, of the double bracket of the arch elements of the support arch, FIG. 5 is a top view of a folded arch element unit of a support arch, FIG. 6 is a perspective view of a joint between two arch elements, FIG. 7 is a perspective view of an alternative construction of the beam of a supporting framework, and FIG. 8 is a perspective view of the top joint of a support arch.

Figure 1:
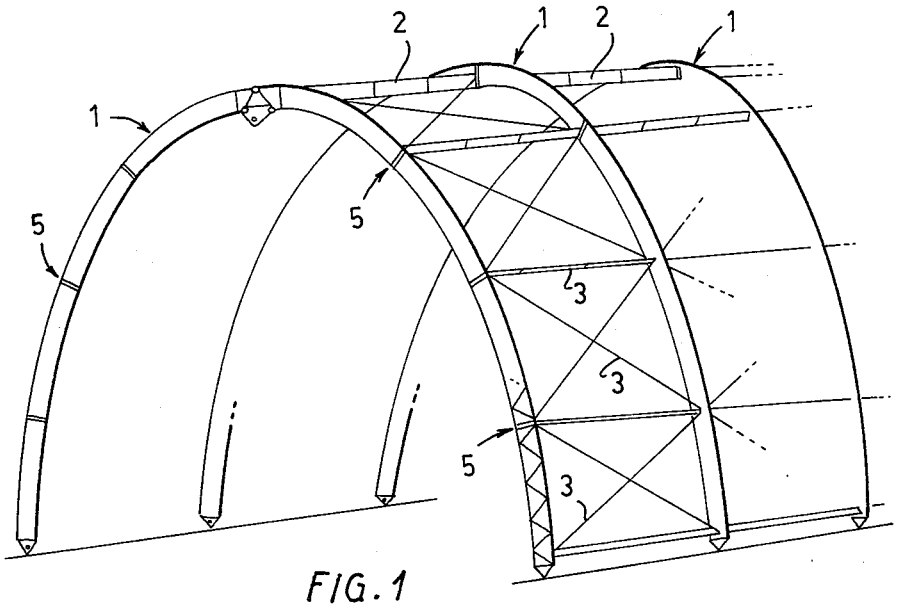

The supporting framework for a shelter shed shown in the drawings comprises a number of support arches 1, which are fastened at a distance from each other by means of transversal beams 2 and rigidified by means of wind braces 3. Each support arch consists of several arch elements 4, which are fastened one after the other rigidly by means of joints 5. A tarpaulin or similar protective covering is supposed to be stretched upon the supporting framework.

Figure 4:
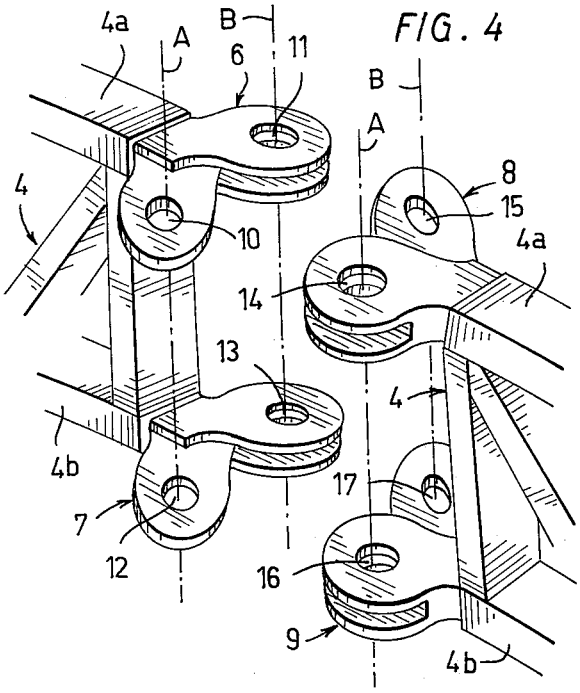

In accordance with the invention, both ends of each arch element are provided with two identical double brackets 6, 7 and 8, 9, respectively, each of which brackets is provided with a through hole 10 to 17, as appears especially from FIG. 4. The brackets 6 and 8 are fastened to the outer edge 4*a* of the arch element and the brackets 7 and 9 to the inner edge 4*b*. The arrangement is such that the holes of the double brackets at one end of the arch element are positioned in pairs coaxially with each other, i.e. the hole 10 of the double bracket 6 is coaxial with the hole 12 of the double bracket 7, and the hole 11 is coaxial with the hole 13 of the double bracket 7, etc. The axes A and B of both pairs of holes are parallel with each other and directed towards the centre of curvature of the support arch. As the curvature of the arch element 4 corresponds in this embodiment to the curvature of the support arch, the axes of the pairs of holes are parallel with the radii of curvature passing through these holes.

Figure 6:
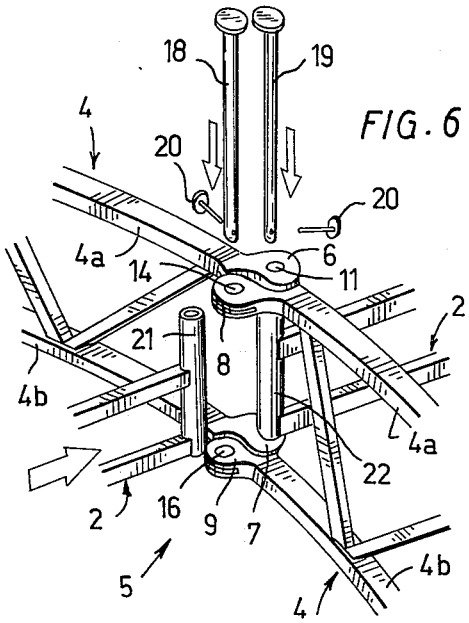
Figure 7:
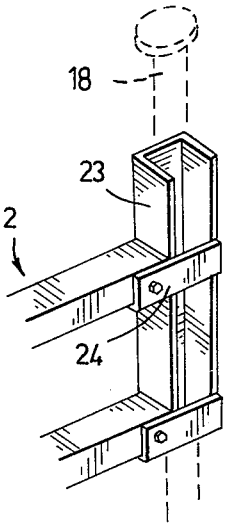
Figure 2:
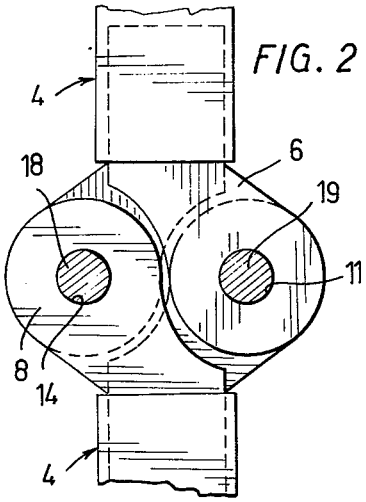

The shape of the double brackets is such that the double brackets 6 to 9 of two subsequent arch elements always fit inside each other so that their holes coincide in pairs, as is shown in FIG. 2. Through both groups of holes, 10, 14, 12, 16 and 11, 15, 13, 17, respectively, it is possible to pass fastening pins 18, 19, which are locked in position by means of cotter pins 20 (FIG. 6). In this way, subsequent arch elements can be locked with each other rigidly.

Figure 3:
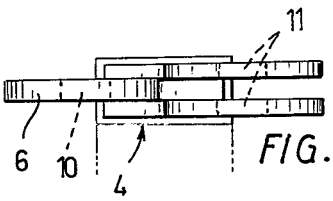
Figure 5:
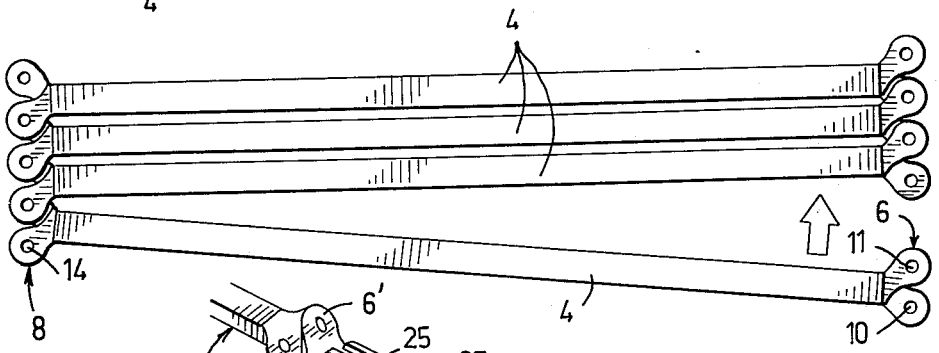

By removing one of the fastening pins, e.g. 18 from each joint, the remaining fastening pin 19 will act as a pivot shaft around which the arch elements can be pivoted. In this way the arch elements can be folded with their flat sides against each other side by side into a uniform bundle, as is shown in FIG. 5. This, of course, requires that the axes of both hole groups of the double brackets are positioned in the side planes of the arch elements, or preferably somewhat outside said planes, as appears from FIGS. 2 and 3.

In order that the double brackets of the joints between the arch elements should not lose their engagement when the fastening pins are removed for the purpose of removal of the beams, it is preferable to place short fastening bushings at least in one pair of holes 10, 14 and 12, 16, respectively, of each pair of double brackets 6, 8 and 7, 9, respectively, of the joint, and preferably in all the pairs of holes, which bushings retain the brackets fastened to each other despite removal of the fastening pins and through which bushings the fastening pins are passed into position in the locking position. The fastening bushing placed in one pair of holes of each pair of double brackets is then removed for the purpose of folding up the arch elements.

The fastening pins 18, 19 of the joints can be utilized for fastening the transversal beams 2 to the arch elements, and for this purpose tube-like elements in the form of fastening tubes 21, 22 parallel with each other are fastened at the opposite ends of the beams, the length of which tubes corresponds to the distance between the two pairs of double brackets 6, 8 and 7, 9, respectively, of the joint between the arch elements and through which tubes the corresponding fastening pins can be passed as shown in FIG. 6.

Alternatively, the opposite ends of the beams may be provided with tube-like elements in the form of mutually parallel U-shaped fastening channels 23, the length of which corresponds to the distance between the two pairs of double brackets 6, 8 and 7, 9, respectively, of the joint between the arch elements and which can be arranged in the transversal direction around corresponding fastening pins of the double brackets and locked in position by means of locking levers 24.

Figure 8:
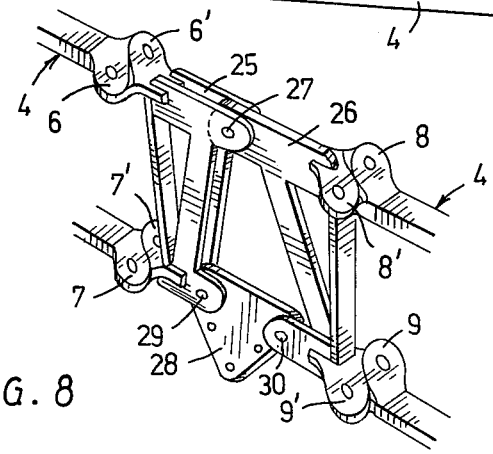

FIG. 8 shows the top joint of the support arch, in which joint intermediate members 25, 26 are positioned between two subsequent arch elements, both of which members are provided with double brackets 6', 7', 8', and 9' corresponding to the double brackets of the arch elements, which brackets are fastened to the double brackets of the arch elements by means of fastening pins. The intermediate members are adjustably connected to each other by means of an outer joint 27 and to an adjusting disk 28 by means of inner joints 29, 30. The adjusting disk permits adjustment of the mutual angular position between the two arch halves of the support arch (FIG. 1) so that the span of the support arch can be adjusted.

Figure 9:
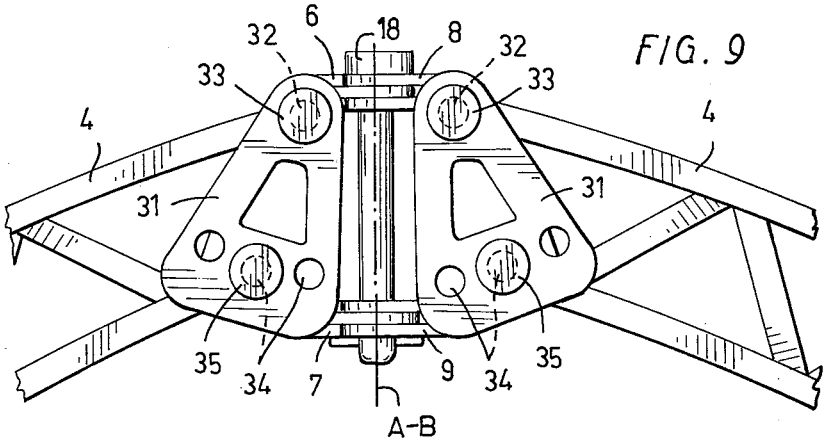
FIG. 9 is a side view of an alternative top joint of a support arch.
Figure 11:
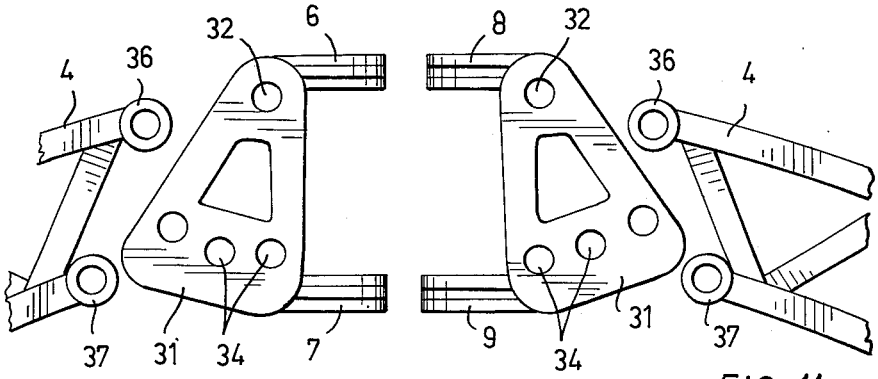
FIG. 11 is a view of the disassembled top joint.
Figure 10:
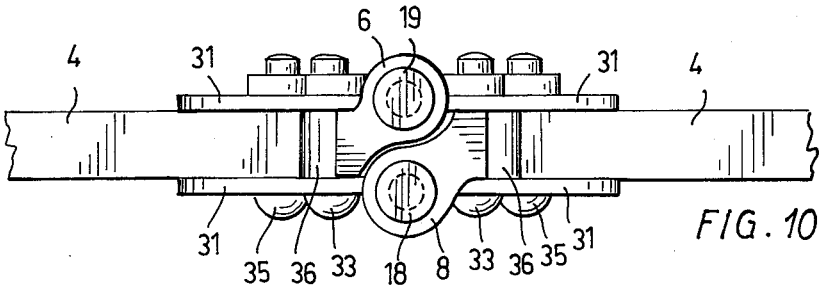
FIG. 10 is a top view of the top joint.

FIGS. 9 to 11 show an alternative top joint of a support arch, wherein the angle between the arch elements can similarly be adjusted to change the span of the support arch. Such a joint can also be used at other joints of the support arch where the angle between the arch elements must be adjustable in order to change the shape of the support arch.

In this embodiment, the ends of the arch elements 4 are also provided with double brackets 6, 7 and 8, 9, respectively, but these brackets are pivotedly mounted at the ends of the arch elements by means of adjusting plates 31. The brackets 6, 7 are fastened in mutual parallelism rigidly, for instance, by welding to two parallel adjusting plates, and the brackets 8, 9 are fastened in a similar manner to a second pair of adjusting plates. The adjusting plates are adjacent the upper brackets 6, 8 each pivoted with a hole 32 for a transverse pivot pin 33, and adjacent the lower brackets 7, 9 with a plurality of holes 34 located at mutual distances on a circular arc, the centre of which is constituted by the central point of the hole 32, said holes 34 being intended for a transverse adjusting pin 35. At the ends of the arch elements 4, there are formed corresponding transverse bushings 36, 37 through which said pins can be inserted. The double brackets 6 - 9 are interconnected in the manner described above by means of fastening pins 18, 19.

The angle between the arch elements is changed by removing one or both adjusting pins 35, by turning the arch element or elements around the pivot pin 35 so as to position the lower bushing 37 of the arch element adjacent to a hole 34 corresponding to the desired angle of the arch elements and by locking the adjusting plates to the arch elements by means of the pins 35. In this way, the angle between the arch element 4 and the axial line A-B of its double brackets can be adjusted.

Instead of adjusting pins 35, an adjusting screw can be used to obtain a stepless adjustment.

The drawing and the related specification are only intended to illustrate the idea of the invention. In its details, the support framework in accordance with the invention may vary even to a considerable extent within the scope of the patent claims. This applies especially to the shape of the double brackets.

Figure 12:
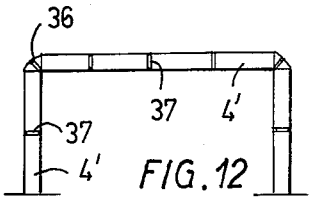
FIGS. 12 and 13 are side views of alternative basic embodiments of support arches.
Figure 13:
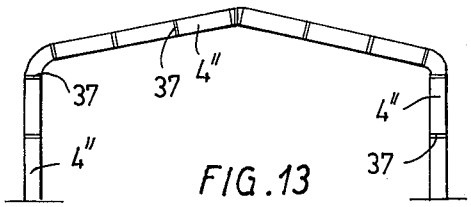

Although all support arch elements 4 described above are curved, it is obvious that the arch elements can also be straight or be of some other shape. FIG. 12 shows a support arch consisting of straight arch elements 4', whereby the arch elements are at the corners of the support arch provided with joints 36 according to FIG. 9, and at other places with joints 37 according to FIGS. 2 – 4. FIG. 13 shows a support arch consisting of a combination of straight and curved arch elements 4'', whereby, for example, each vertical wall beam and the horizontal roof beam can be folded in the manner described in the foregoing owing to the brackets according to the invention.

What I claim is:

1. In a shelter shed supporting framework of the type including a plurality of support arches each made up of a plurality of arch elements with the ends positioned in adjacency for interconnection with one another and with traverse beams interconnecting the arches at predetermined distances apart; the provision of spaced pairs of articulated point means at adjacent ends of the arch elements and beams for interconnecting the same and comprising double brackets arranged in spaced pairs at the ends of adjacent arch elements with one double bracket in substantial alignment with the outer edge of its associated arch element and with the other double bracket in substantial alignment with the inner edge of its associated arch element and with coaxial holes through the brackets of each pair; tube-like elements carried at opposite ends of each beam and being parallel to one another and of a length corresponding to the distance between adjacent brackets of each double bracket and fitting therebetween with the openings through the tube-like elements in coaxial alignment with respective pairs of holes in the brackets; and fastening pins extending through aligned bracket holes and tube-like elements for connecting the arch elements and transverse beams at the joint means; the axes of the holes through the spaced brackets of each pair being parallel with the radius of curvature of the support arch whereby successive arch elements can be pivoted side-by-side about the axis of either spaced brackets when the pin through the other spaced brackets is removed.

2. In a shelter shed supporting framework as claimed in claim 1, wherein the tube-like elements are cylindrical.

3. In a shelter shed supporting framework as claimed in claim 1, wherein the tube-like elements are channel shaped permitting transverse positioning thereof about pins positioned in the respective bracket holes.

4. In a shelter shed supporting framework as claimed in claim 3, wherein there are provided locking levers to traverse the channel opening and lock the channel shaped elements in position.

5. In a shelter shed supporting framework as claimed in claim 1, wherein fastening bushings are disposed in the coaxial bracket holes of each pair of brackets and through which the fastening pins extend.

6. In a shelter shed supporting framework as claimed in claim 1, wherein the double brackets at the same end of adjacent arch elements are attached to an adjusting device pivotally connected at said end of an arch element by pivot pins extruding at right angles to the coaxial bracket holes.

7. In shelter shed supporting framework as claimed in claim 6, wherein the adjusting device comprises a pair of plates each provided with a hole for receiving a pivot pin and a row of adjustment apertures spaced along an arc from the pin receiving hole whereby the distance between the pin receiving hole and a selected adjustment aperture may be varied in accordance with the distance between pin receiving openings on the arch elements.

* * * * *